US010640960B2

(12) United States Patent
Connerton

(10) Patent No.: US 10,640,960 B2
(45) Date of Patent: May 5, 2020

(54) SPLASHLESS PLUNGING DEVICE

(71) Applicant: DIAMOND FLUSH LLC, White Plains, NY (US)

(72) Inventor: Thomas J. Connerton, Stamford, CT (US)

(73) Assignee: DIAMOND FLUSH LLC, White Plains, NY (US)

( * ) Notice: Subject to any disclaimer, the term of this patent is extended or adjusted under 35 U.S.C. 154(b) by 0 days.

(21) Appl. No.: 15/382,025

(22) Filed: Dec. 16, 2016

(65) Prior Publication Data

US 2018/0171612 A1 Jun. 21, 2018

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.01, 255.02–255.11
See application file for complete search history.

(56) References Cited

U.S. PATENT DOCUMENTS 6,779,202 B1 8/2004 Alldredge
7,229,519 B2 11/2007 Garry
8,083,864 B2 * 12/2011 Ho ..... B08B 3/12 134/166 C
9,630,221 B2 * 4/2017 Brummer ..... B08B 9/02
2007/0006412 A1 1/2007 Soller
2009/0095646 A1 4/2009 Reynolds
2014/0182052 A1 * 7/2014 Cohen ..... E03C 1/308 4/255.11
2015/0121637 A1 5/2015 Brenner
2015/0143623 A1 5/2015 Brummer
2016/0000281 A1 * 1/2016 Butts ..... A47G 29/08 206/581

OTHER PUBLICATIONS

Search Report and Written Opinion.

* cited by examiner

*Primary Examiner* — Christine J Skubinna
(74) *Attorney, Agent, or Firm* — Tarter Krinsky & Drogin LLP

(57) ABSTRACT

A device for removing an obstruction from a pipe or toilet generally includes a handle portion and a flexible head portion having a plurality of grooves. The flexible head portion is configured for insertion into a pipe. The flexible head portion is configured by shape and/or size to allow water from the pipe or toilet to move over the flexible head portion between the flexible head portion and the pipe or drain wall while the plunger is manipulated in the pipe or toilet. Using the handle portion, the flexible head portion can be moved along the inner wall of the pipe to move a column of liquid to effect the removal of the obstruction. If the intervals between the grooves are in contact with the pipe wall, water may still pass between the flexible head portion and the pipe through the grooves. A storage case for the device is provided.

27 Claims, 7 Drawing Sheets

SPLASHLESS PLUNGING DEVICE

FIELD OF THE INVENTION

The present invention relates to devices for removing obstructions from piping, and more particularly, to a plunging device for removing obstructions from pipes or toilets that limits and/or prevents the formation of splash.

BACKGROUND OF THE INVENTION

Plunging devices for removing obstructions from piping and toilets (plungers and the like) are fairly well known and there are several known types of plunging devices currently available. While numerous plunging devices exist, most currently lay within one of three categories. The three categories of plunging devices are: traditional plunger-type devices comprising suction cups (air/water reciprocators), splash shield plunging devices, and snake-type plunging devices.

Traditional plunging devices generally comprise malleable rubber cups, suction cups and/or accordion-like structures that fit about or proximate a drain threshold or toilet drain orifice; such plunging devices typically utilize contained amounts of reciprocating air and water to remove an obstruction. A problem associated with traditional plunging devices, however, is that during operations they typically do not allow liquids to pass into a pipe being plunged and they are unsanitary. Indeed, when used such devices typically create splash, which may be contaminated with fecal matter that can contaminate an area proximate a toilet or drain being plunged. In attempts to address splash problems, individuals have developed plunging devices comprising splash shields. As may be imagined, such plunging devices typically include a shielding device for preventing splash from contaminating surrounding areas. Many cover a toilet opening or the like. While splash shield plunging devices are generally effective for their intended purpose, they do not function to prevent and/or minimize the initial formation of splash. Finally, snake-like plunging devices generally include flexible probing members that may be inserted into a drain to directly contact a blockage and remove it from the drain. Hence, many snake-like plunging devices include barbed end portions or the like for securing the matter causing the blockage and removing it from the pipe. While these types of plunging device are satisfactory for their intended purpose, they too, tend to be unsanitary as they can produce splash. Additionally, contaminants typically adhere to such devices, especially those comprising barbed end portions.

U.S. Pat. No. 6,779,202 to Alldredge discloses a plunger with a head fabricated from a resilient material that includes a convex distal end. In one embodiment, the head also includes a plurality of alternating grooves and lobes that extend radially to the outer edge of the head. The stated purpose of the grooves is to create gaps that "allow each lobe to be flexed in directions both axially and radially of the head, suited when fitted into the passage 20 (toilet drain pipe) to achieve a head sealing or piston fit within the bowl passage, even should the head be axially misaligned with the passage. The convex nose surface 76 provides for easy initial head entry into the bowl passage." (Alldredge, col. 4, lines 25-31.) However, the sealing fit created by the head in Alldredge creates splash when the head is moved in and out of the toilet passage and the radial orientation of the lobes enables waste material to be trapped in the gaps between the individual lobes.

Thus, there exists a longfelt need for a more sanitary plunging device that prevents and/or minimizes the formation of splash.

BRIEF SUMMARY OF THE INVENTION

A device for removing an obstruction from a pipe including: a flexible head portion having a first end and a second end and operatively arranged for insertion into the pipe, the flexible head portion configured for moving a column of liquid within the pipe; a plurality of longitudinal grooves extending along the length of the flexible head portion and configured to allow the liquid to pass between the outer surface of the flexible head portion and the wall of the pipe to move a column of liquid within the pipe; and, a handle portion attached to the second end.

The present invention also comprises a method of removing an obstruction from a pipe that includes inserting a plunging device that includes a handle portion and a flexible head portion having a plurality of grooves into the pipe; and moving the plunger-type device to cause movement of the flexible head portion within the pipe such that a column of liquid therein is moved between the outer surface of the flexible head portion and the pipe.

An object of the invention is to provide an improved plunging device for removing obstructions from a pipe or toilet.

A second object of the invention is to provide an improved plunging device for removing obstructions from a pipe or toilet which is more sanitary.

A third object of the invention is to provide an improved plunging device for removing obstructions from a pipe or toilet which device prevents and/or minimizes the formation of splash.

An additional object of the invention is to provide an improved method for removing obstructions from a pipe or toilet which is more sanitary.

These and other objects, features and advantages of the present invention will become readily apparent to those having ordinary skill in the art upon reading the detailed description of the invention in view of the drawings and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

It should be appreciated at the outset that like drawing numbers on different drawing views identify identical structural elements of the invention. Additionally, while the present invention is described with respect to what is presently considered to be the preferred embodiments, it is to be understood that the invention as claimed is not limited to the disclosed embodiments. In the description and claims that follow, "plunger", "plunging device" and like terms are intended to refer to devices for removing obstructions from pipes, drains and/or toilets, etc. and are not intended to refer solely to devices comprising rubber suction cups and/or plunging devices including accordion-like bellows means. It should be further appreciated that while we discuss the present invention in association with toilets, toilet waste pipes and the like, the present invention may be utilized for removing blockages from virtually any type piping system for moving a liquid.

Figure 1:
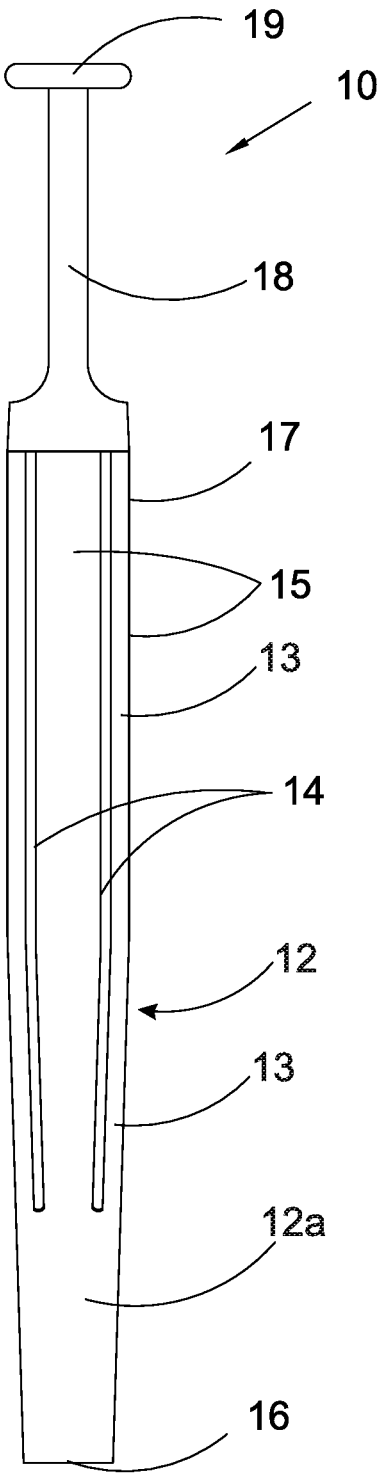
FIG. 1 is a side view of the plunger of the present invention.

Adverting now to the figures, FIG. 1 is a side view of plunger 10 including flexible head portion 12 ("head portion 12") and handle 18. Handle 18 may have different thicknesses as seen, for example, in FIGS. 1 and 2 and may also have different terminal ends 19 as seen, for example, in FIGS. 1 and 5. In the present invention, flexible head portion 12 is configured to allow a liquid such as water in an obstructed pipe or drain to pass from one end of flexible head portion 12 to the other end between the outer surface of flexible head portion 12 and the wall or walls of the pipe or drain to move a column of liquid within the pipe or drain. By configured is meant to arrange or prepare something so that it can be used. Thus, the shape and/or size of flexible head portion 12 is configured to allow the water or other liquid to pass up from below end 16 and vice versa between the wall(s) of a pipe or drain. In the embodiment shown, flexible head portion 12 tapers toward end 16 which enables end 16 to be inserted into pipes and drains having small inner dimensions. In other embodiments described below, head portion 12 may have the same width from first end 16 to second 17.

In addition, flexible head portion 12 includes a plurality of longitudinal grooves 14 ("grooves 14") that extend along the length-wise dimension of flexible head portion 12. By longitudinal is meant placed or going along the long side of something, in this case the long side of head portion 12. Although any number of grooves 14 can be incorporated into flexible head portion 12, a preferred number ranges from 2 to 22 grooves. A more preferred number ranges from two to eight grooves. A still more preferred number is four grooves. Preferably, grooves 14 are substantially parallel. In an alternate embodiment, grooves 14 may have other arrangements including but not limited to a spiral configuration around the circumference of head portion 12 as shown in FIG. 3. Grooves 14 may extend along the entire length of flexible head portion 12 from end 17 to end 16/16*a* or may terminate about 6 to 8 inches from end 16/16*a* where flexible head portion 12 starts to taper as seen in FIGS. 1-3.

Figure 2:
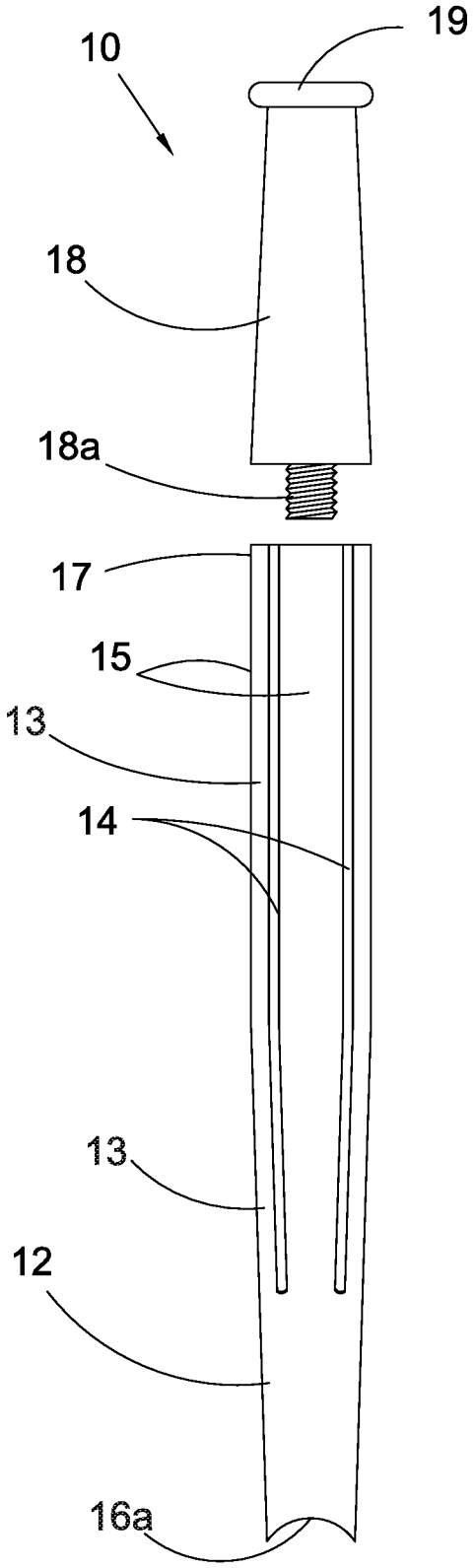
FIG. 2 is a side view of an alternate embodiment of the plunger of the present invention in which the handle is shown as removable.
Figure 3:
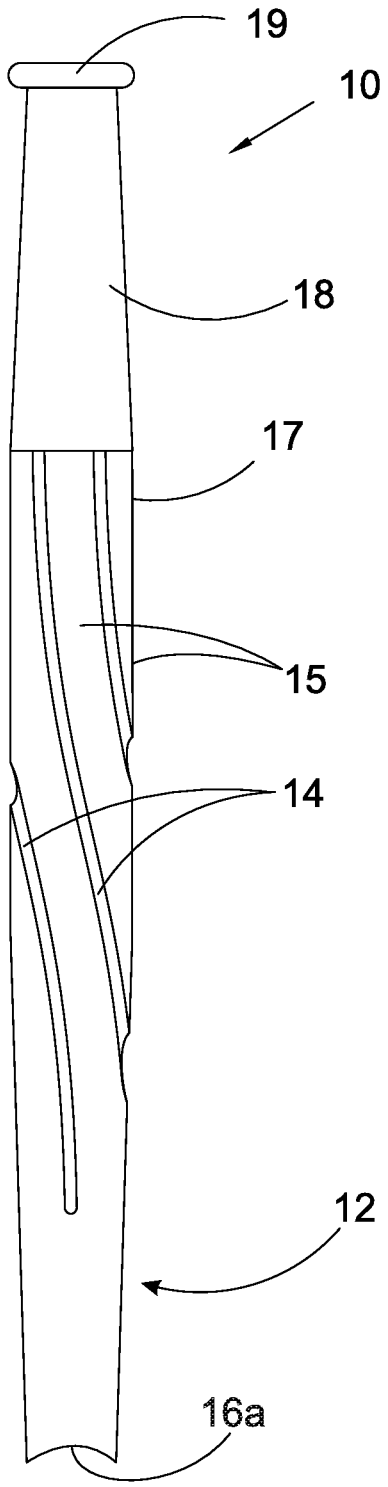
FIG. 3 is a side view a second alternate embodiment of the plunger of the present invention in which the grooves extend in a spiral configuration longitudinally around the length of the plunger.

In the embodiment shown in FIG. 1, first end 16 is flat FIG. 2 depicts a preferred embodiment in which first end 16*a* is concave. The concavity of first end 16*a* may range from a minimum of 1/16 inch to a preferred depth of at least 1/4 inch although concavity depths may range to be greater than 1/4 inch. It has been found that the concavity of end 16*a* enables plunger 10 to "grasp" or "pull" a column of water in the drain pipe as explained below. The diameter of end 16/16*a* should be sufficient to enable a user to push end 16/16*a* into the head of pipe 34. A typical effective diameter would be 1 1/8 inches.

Second end 17 of flexible head portion 12 receives handle 18 which in the embodiment shown includes knob 19. Flexible head portion 12 is formed from a flexible material, such as rubber, foam, or soft plastic, such that the flexible head may "snake" or bend within a toilet waste pipe or other pipe. In a preferred embodiment, flexible head portion 12 is formed from rubber, flexible foam or other cellular material such as polyurethane, or other suitable materials known to those skilled in the art.

The depth of grooves 14 are preferably approximately 1/4 inch deep as measured from the edge of the groove. Grooves 14 allow water to pass from below first end 16 or 16*a* through to above end 17 of head 12. This allows for a "splashless" effect. No matter how head portion 12 is bent with drain 34, head portion 12 is constructed such that grooves 14 do not close at either end so that a liquid, such as water, can pass in both directions through grooves 14 even when intervals 15 are in close contact or sealing contact with the inner wall of pipe or drain 34. In the preferred embodiment in which first end 16*a* is concave, the concavity of end 16*a* possesses the advantage of enabling an upward movement of plunger 10 to "pull" or "grasp" a column of water in the pipe by creating a greater pressure differential between the water between end 16*a* and the water above end 17 than would be created with a flat end 16. It has been found that the deeper the concavity the greater the ability to pull a column of water.

The outer surface of flexible head portion 12, including grooves 14 and intervals 15 between grooves 14, is preferably smooth and may comprise a flexible non-stick coating such as TEFLON® in order to prevent and/or minimize contaminants from adhering to the surface of the flexible head portion 12. Other suitable coatings include, but are not limited to, NEVERWET® from NeverWet LLC, Lancaster, Pa. 17601 and ULTRA EVER DRY® from UltraTech International, Inc. Jacksonville, Fla. 32256. The outer surface may also comprise a smooth semi-porous or non-porous outer covering adapted for fit about the flexible head portion. For example, such outer covering could be formed from plastic sheet material or from flexible non-stick fabrics. Such non-stick fabrics preferably comprise TEFLON® coatings or are formed from materials made coated or infused with TEFLON®, NEVERWET®, ULTRA EVER DRY®, plastic, rubber and/or other like materials. The outer covering may also be adapted to be easily removed from the flexible head portion for easy disposal thereof after use. Preferably, the coatings are hydrophobic.

FIG. 2 also depicts an embodiment of plunger 10 in which handle 18 is shown as removable from flexible head portion 12. In the embodiment shown, threaded portion 18*a* is threaded into a suitable threaded receiver (not shown) in end 17. Persons of skill in the art will recognize that other attachment methods may be used such as friction fittings. Also seen in FIG. 2 is the concave shape of end 16*a*. It has been found that the concave shape may aid in reducing or eliminating splash when plunger 10 is moved within a pipe. The concavity of first end 16*a* may range from a minimum of 1/16 inch to a preferred depth of at least ¼ inch although concavity depths may range be greater than ¼ inch.

In the embodiments shown in FIGS. 1 and 2, flexible head portion 12 is configured so that the tapered shape allows flexible head portion 12 to be more easily placed into a pipe without substantially reducing or stopping the flow of the liquid in the pipe from passing between the pipe and flexible head portion 12. Toward that end, grooves 14 also aid in allowing liquid to pass between flexible head portion 12 and a pipe. First end 16 or 16*a* should be between 1⅛ inches to 1½ inches in diameter although depending on the size of the drain pipe in the toilet, the size may be larger or smaller. For example, with an older style toilet with a drain pipe inner diameter of 2½ inches, the diameter of the first end 16/16*a* would preferably range from 1½ to 2 inches.

The material forming head 12 may be formed from material that allows for contraction and expansion of head 12. This enables head 12 to be contracted or squeezed against the inner wall of a pipe if head 12 is pushed through a pipe with an inner diameter smaller than its diameter when at a rest position followed by its expansion to its original diameter when removed from the pipe. Even if intervals 15 are pressed to contact an inner pipe wall, it will be noted that grooves 14 prevent the formation of a complete seal against the inner wall of a drain pipe by head 12 as water or other liquid can pass into and out of grooves 14 from below end 16/16*a* toward and possibly above end 17 and vice versa. Both up and down strokes allow passage of water through grooves 14. Up and down means moving handle 18 up or down corresponding to out of or into the drain or pipe, respectively.

Figure 4:
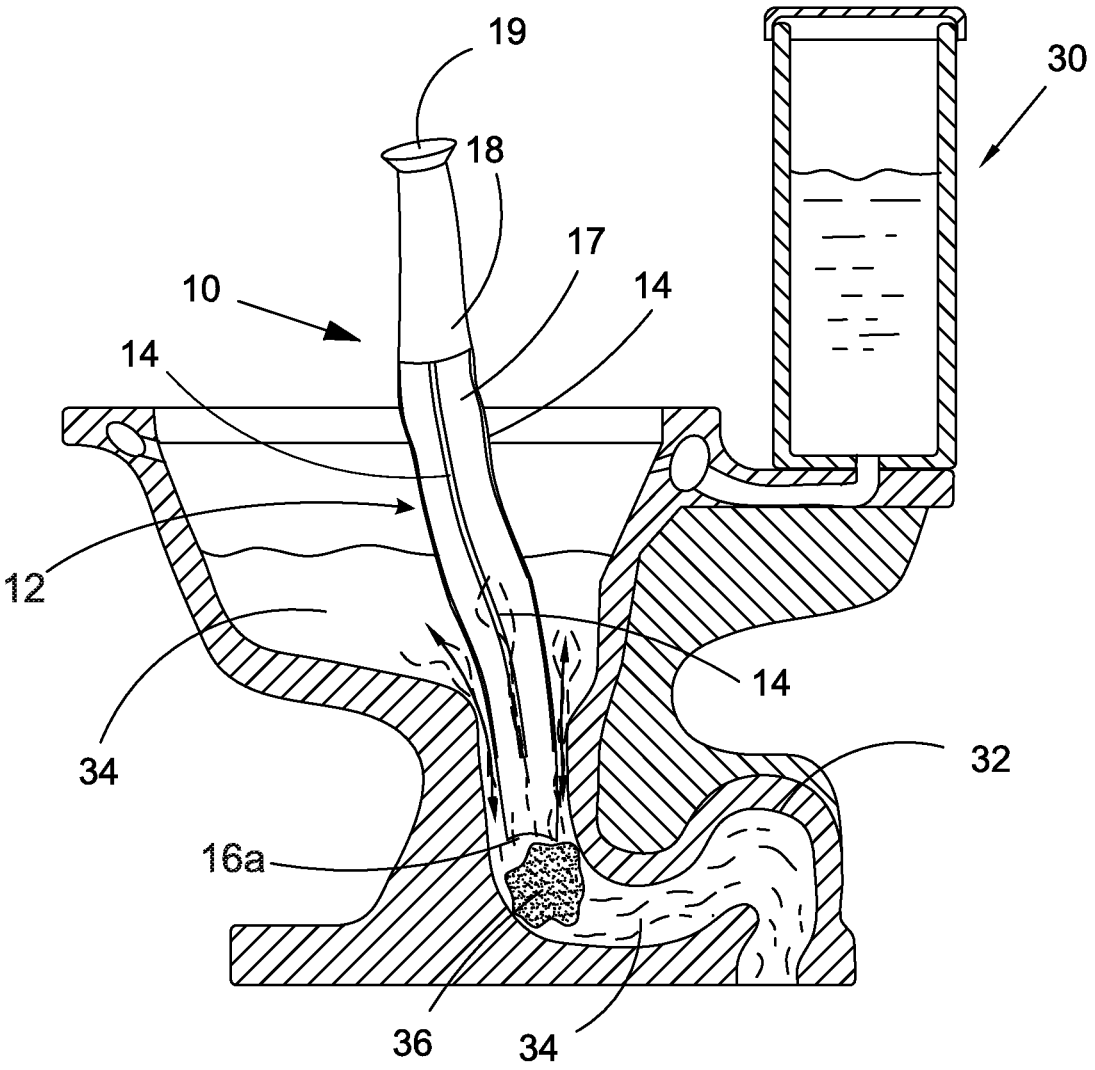
FIG. 4 is a cross-section of a toilet and toilet drain showing water in the drain passing between the plunger of the present invention and the wall of the drain.

This is seen in FIG. 4 depicting flexible head portion 12 being inserted into drain (pipe) 32 of toilet 30 plugged by obstruction 36. The arrows depict water (or other liquid) 34 passing from below end 16*a* and obstruction 36 to above the opening into drain 32 through grooves 14. It will be recognized that when plunger 10 is moved in the opposite direction, water 34 will move in the opposite direction back through grooves 14 into drain 32 between flexible head portion 12 and the wall of drain 32.

It will be recognized by those skilled in the art that the length of flexible head portion 12 and the shape of grooves 14 will depend on the predicted use of plunger 10. In one embodiment, flexible head portion 12 will be about 16 inches in length with grooves 14 ranging in length from about ¾ of the length to the total length of flexible head portion 12. However, it will be recognized by those having skill in the art that the length of head portion 12 can be adapted to be used in pipe varying in length and diameter. Grooves 14 range from about ⅛ to about ¾ inch in width and depth.

Continuous feeding of flexible head 12 into the pipe toward obstruction 36 increases the pressure exerted upon the water (liquid) column below end 16/16*a*, which, in turn, acts to exert a force upon obstruction 36. Upon application of sufficient pressure from the water (liquid) column, obstruction 36 may be forced along the length of the pipe and removed therefrom. In operation, for example, to remove a blockage from a toilet, quick downward plunging motions toward obstruction 36 and slower upward motions are generally preferred. Quick downward motions are preferred because they tend to create sufficient pressure to move the blockage along the pipe. Slower upward strokes are generally preferred because as the blockage 36 is moved along the pipe and the plunging device is subsequently raised, an area of low pressure is formed below the end of the plunging device. The formation of an area of lower pressure creates a pressure differential between liquid held in the toilet bowl and the liquid in the toilet pipe proximate the blockage. As a result, on the upstroke, liquid contained in the toilet bowl may pass into the pipe to fill the pipe in time for the next down stroke into toilet drain 34. When flexible head portion 12 with grooves 14 is utilized, liquid from the toilet bowl may be transferred through grooves 14 into the toilet pipe during the downstroke or upstroke. This action will move water and obstruction 36 along pipe 34 to include over the apex of drain 34, if necessary. The various embodiments of the present invention are generally columnar in design, have smoothed surfaces, do not comprise large suction cups or accordion-like bellows that that require violent reciprocating movements, and allow liquid to pass between a toilet bowl and a toilet pipe during plunging operations, thereby removing liquid from the toilet bowl during plunging operations. Therefore, the present invention is particularly advantageous for preventing and/or minimizing splash as water tends to be pulled down into the drain. Typically a few, quick downward plunges of the device of the present invention are all that is required to move a blockage 34 along a pipe or drain to enable a toilet to empty properly.

End 16 or 16*a* of flexible head portion 12 may possess a flat or preferably concave surface, respectively, which may affect water (liquid) column pressure that is applied to a blockage. Flexible head portion 12 may further be adapted to be solid or substantially hollow for reducing weight and/or increasing flexibility. Where flexible head portion 12 is substantially hollow, end 16 remains covered/closed so as to prevent entry of liquid therein. As mentioned above, end 16/16*a* is preferably concave to more efficiently move a column of water by creating a greater pressure differential than flat end 16 enabling concave end 16*a* to more easily "pull" the water between end 16*a* and obstruction 36 enabling more water to pass through grooves 14 to below end 16*a* enabling more pressure to be placed on obstruction 36 on the down stroke.

Figure 5:
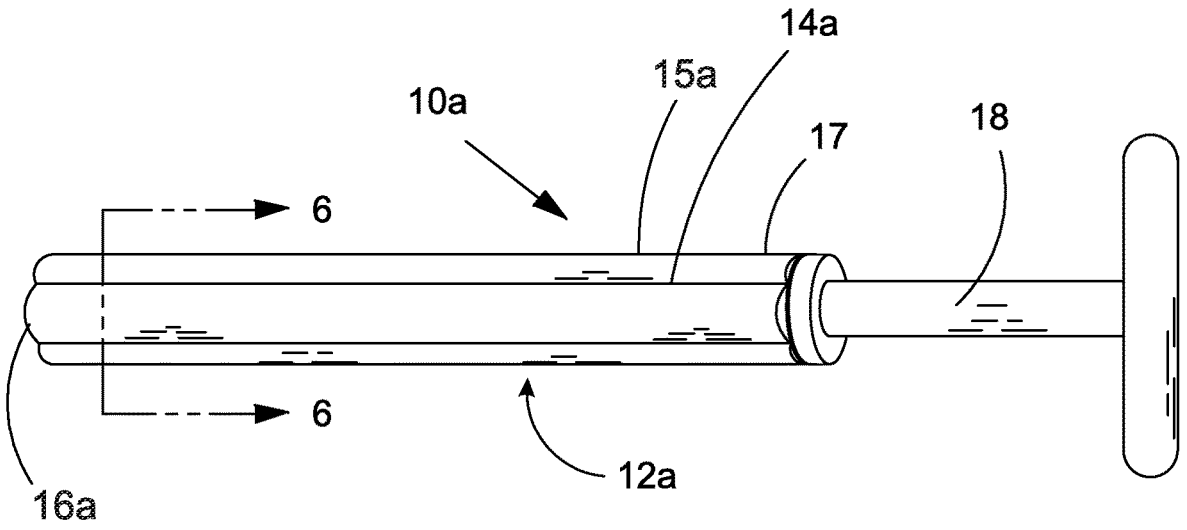
FIG. 5 is a side view of a third alternate embodiment of the plunger of the present invention.
Figure 6:
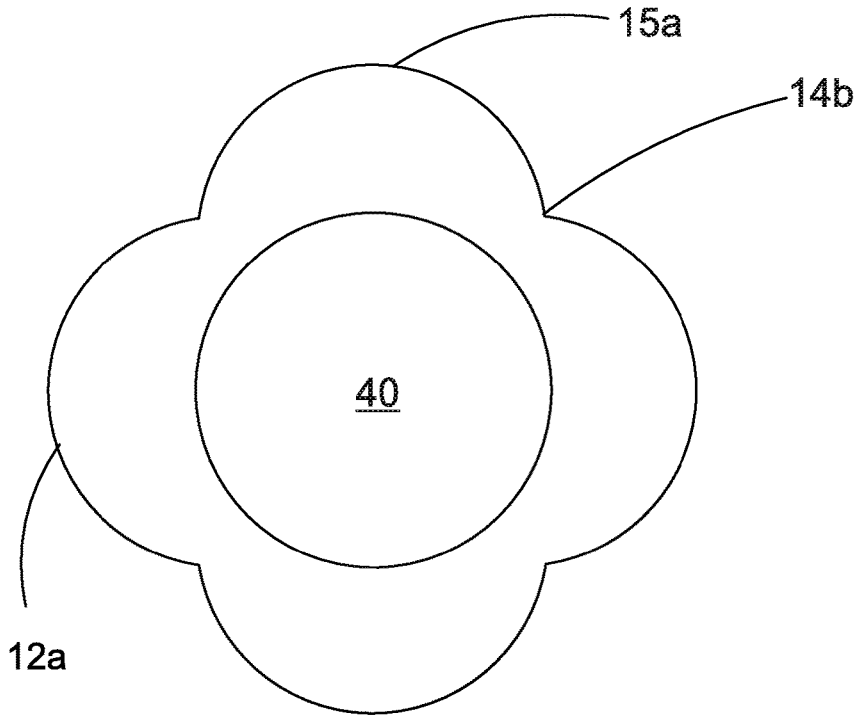
FIG. 6 is a cross-section of the third alternate embodiment of the present invention shown in FIG. 5 taken along line 6-6 of FIG. 5.

As illustrated in FIGS. 5-8, flexible head portion 12 may be adapted to comprise various shapes that include grooves 14. More specifically, FIGS. 5 and 6 illustrate embodiment 10*a* comprising flexible head portion 12*a* and having cloverleaf-like cross-sectional shape. Grooves 14*a* of the cloverleaf-like cross-sectional shape of flexible head portion 12*a* allow liquid to pass between the flexible head portion 12*a* and the inner wall(s) of a pipe such that the plunger 10*a* may readily slide therein without splash as described above. Protrusions 15*a* (analogous to intervals 15) are seen between grooves 14*a*. Also, as discussed above, the grooves 14*a* of the cloverleaf-like cross-sectional shape also allow liquids to pass between the flexible head portion 12*a* and the inner walls of a pipe, for example, from a toilet bowl to a toilet drain pipe during plunging operations even though the peak of protrusion 15*a* contacts the wall of the drain or pipe. FIGS. 5 and 6 illustrate that the flexible head portion may comprise hollow portion 40 and end 16/16*a*, which is flat or preferably concave.

Figure 7:
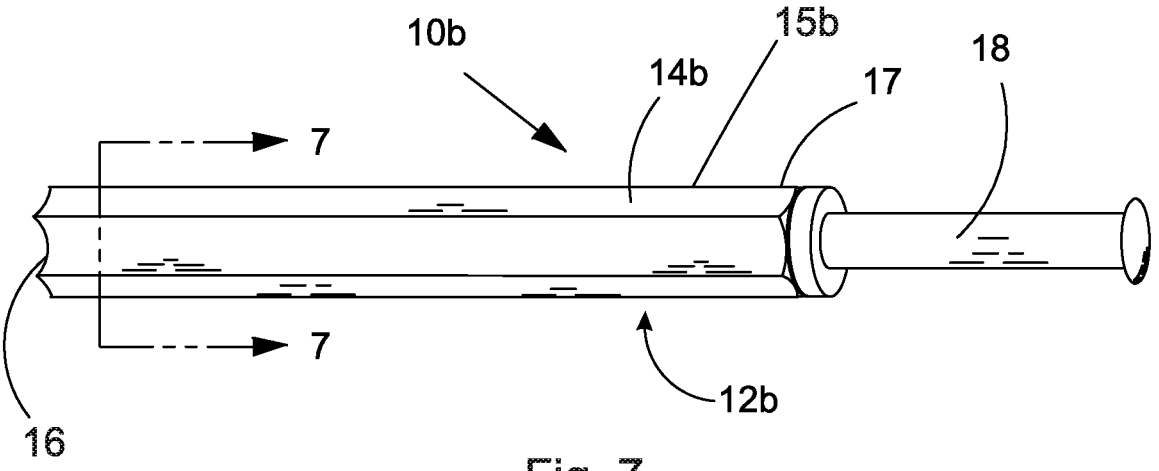
FIG. 7 is a side view of a fourth alternate embodiment of the plunger of the present invention.
Figure 8:
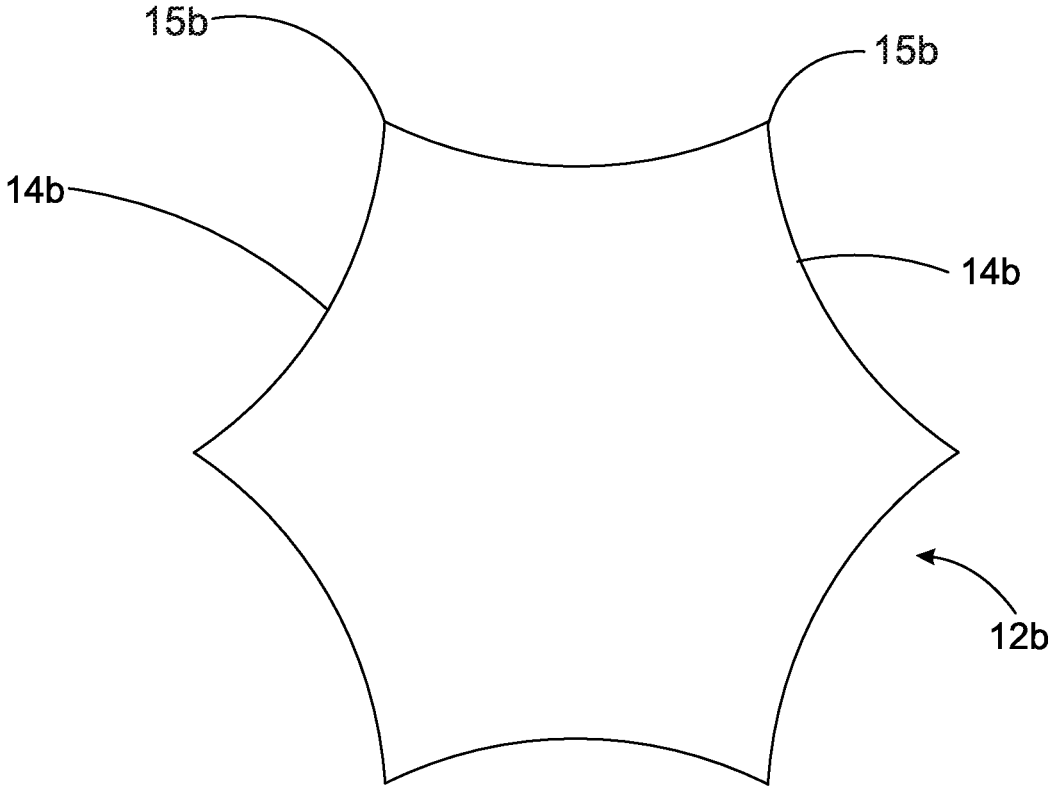
FIG. 8 is a cross-section of the fourth embodiment of the present invention shown in FIG. 5 taken along line 7-7 of FIG. 7.

FIGS. 7 and 8 illustrate embodiment 10*b* comprising flexible head portion 12*b* wherein the flexible head 12*b* has multi-pointed "star-like" protrusions 15*b* and arcuate grooves 14*b*. Similar to embodiment 12*a*, it is believed that embodiment 12*b* with arcuate grooves 14*b* allows an amount of liquid to pass between the flexible head portion 12*b* and the inner wall(s) of a pipe for such that the plunging device may readily slide therein with reduced or no splashing even though the peaks of protrusions 15*b* may contact the wall of the drain or pipe. The star-like cross-sectional shape of head portion 12*b* and arcuate grooves 14*b* may allow an amount of liquid to pass between the flexible head portion 12*b* and the inner walls of a pipe to transfer liquid from a toilet bowl to a toilet pipe during plunging operations. Similar to the embodiments depicted in FIGS. 1-3, the grooves in the embodiments shown in FIGS. 5-8 do not close allowing water to pass through grooves 14 at all times.

It will be recognized that the open grooves have the advantage of providing for greater cleanliness and sanitation that other plungers especially when plungers 10, 10*a*, and 10*b* are coated with the hydrophobic coatings discussed above.

Referring now to FIGS. 1-8, plunging device 10 of the present invention comprises handle portion 18. Handle portion 18 may be formed from a material similar to that of flexible head portion 12 such that flexible head portion 12 and handle portion 18 comprise an integral structure. Alternatively, as illustrated in FIG. 2, handle portion 18 may be adapted to be releasably secured to flexible head portion 12. In such embodiment, handle portion 18 may be formed of a flexible material similar to the flexible head portion or may be formed of a non-flexible material, such as plastic, wood, metal, etc. Handle 18 may include threaded portion 18*a* for acceptance within a threaded bore (not shown) in end 17 of flexible head portion 12. Alternatively, threaded portion 18*a* may act as a tapping screw by forming its own threaded bore within head portion 12 when material such as polyurethane or some rubber materials are used to form flexible head portion 12. Other means known to those skilled in the art for securing handle 18 to flexible head portion 12 may be utilized. Handle 18 may also include a gripping means for more effectively securing the handle portion including, but not limited to, friction fits and adhesives. While FIGS. 1 and 2 illustrate two alternative designs for the handle portion of the present invention, other designs known to those skilled in the art are contemplated and are intended to be encompassed by the present disclosure and claims. Additionally, it should be appreciated that the releasable handle may be removed from one flexible head portion and secured to another of alternative design as may be desired.

Figure 9:
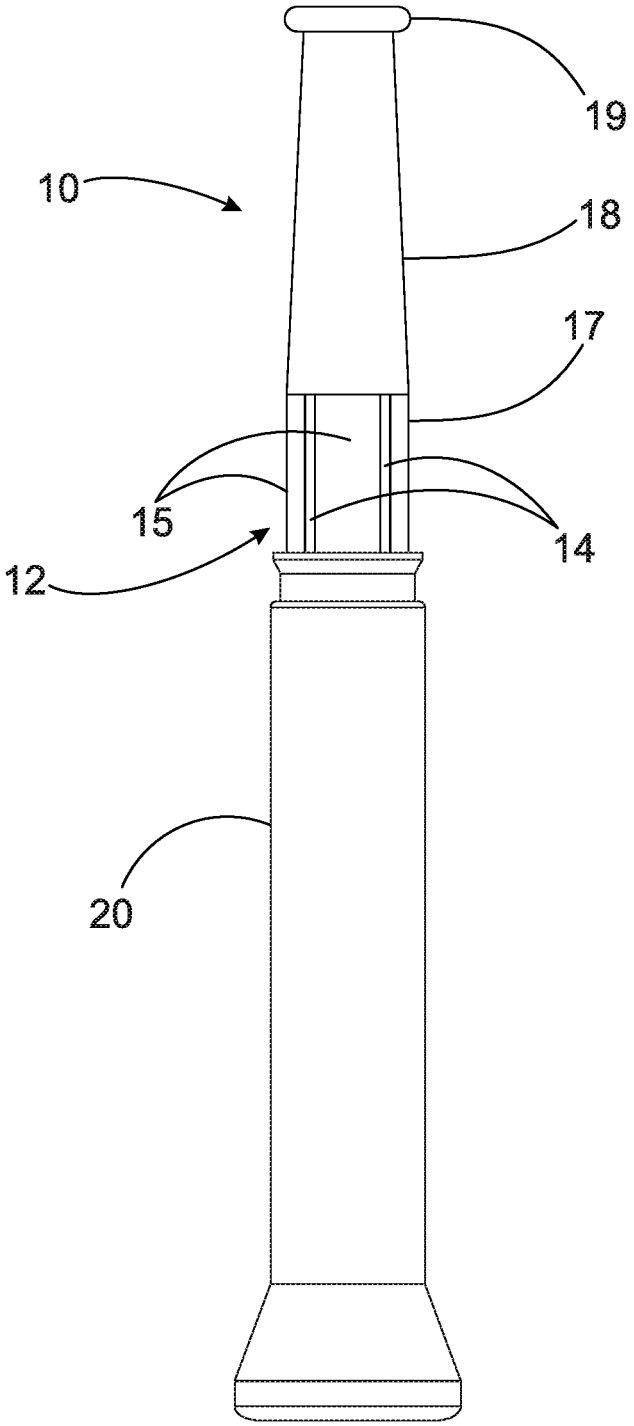
FIG. 9 is side view of the plunger of the present invention partially inserted into a storage case.

A storage case may be provided to store plunger 10 in a sanitary and convenient manner. FIG. 9 is a side view of a case 20 in which head portion 12 fits into a generally tubular or rectangular case 20 with handle 18 protruding from the case. Such a shape allows for storage of plunger 10 using a minimum of space on the floor. Alternatively, case 20 can be mounted on a convenient wall. It is recognized that storage cases may have other shapes.

Figure 10:
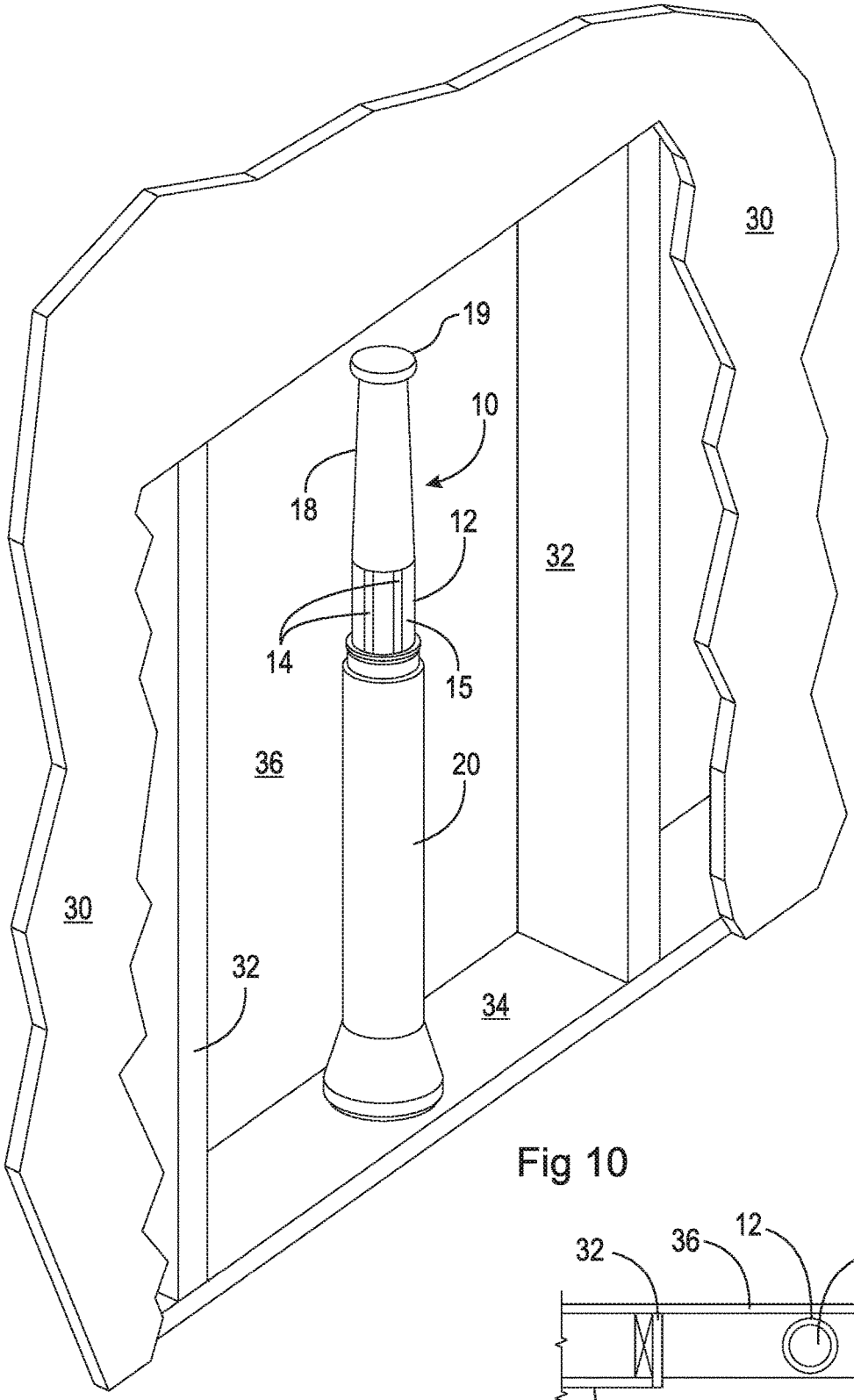
FIG. 10 is a side perspective view of the plunger of the present invention and storage case stored between two wall studs; and, FIG. 10A is a top view of the present invention and storage case placed as in FIG. 10 showing the plunger and case do not extend beyond the outer edge of the wall studs.
Figure 10A:
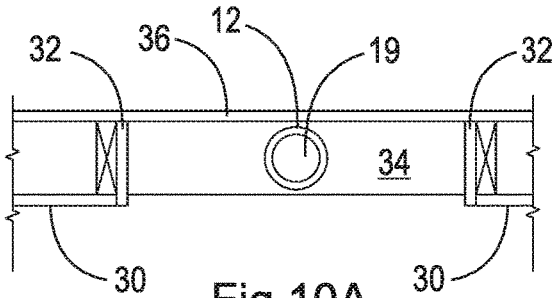

Because of the unique dimensions of plunger 10 and case 20, the assembly of plunger 10 and case 20 possesses the advantage of being able to be mounted within a wall constructed with standard 2×4 studs. For example, with plunger 10 having a diameter of 1½ inches, a case 20 may be up to 3½ inches in diameter which is approximately the width of a 2×4 board. FIG. 10 is a perspective view of the plunger case assembly showing it stored within wall 30 between two 2×4 studs 32. Case 20 is seen resting on shelf or plate 34. Wall 36 forms the back of the storage space. FIG. 10A is a top view of the stored assembly showing how the assembly does not extend beyond the outer edge of each of the two studs 32.

Thus, it is seen that the objects of the present invention are efficiently obtained, although modifications and changes to the invention should be readily apparent to those having ordinary skill in the art, which modifications and changes are intended to be within the spirit and scope of the invention as claimed.

I claim:

1. A device for removing an obstruction from a pipe comprising:

a flexible head portion having a first end and a second end and operatively arranged for insertion into said pipe, said flexible head portion configured to allow said liquid to pass between the outer surface of said flexible head portion and the wall of said pipe for moving a column of liquid within said pipe;

a plurality of longitudinal grooves extending along the length of said flexible head portion; and a handle portion attached to said second end, where the second end of the flexible head portion has a substantially similar diameter as the diameter of the handle portion at the location where the second end and handle portion are attached to each other;

wherein said flexible head portion is shaped to taper toward said first end such that the flexible head portion has a substantially uniform thickness along a shaft of the flexible head portion until it tapers toward the first end, wherein a bottommost portion at the first end has a smaller diameter than the second end attached to the handle.

2. The device as recited in claim 1 wherein said flexible head portion has a substantially rounded cross-sectional shape, wherein the diameter of said substantially rounded cross-sectional shape is smaller than the diameter of the cross-section of said pipe.

3. The device as recited in claim 1 wherein said elongated grooves terminate prior to the first end.

4. The device as recited in claim 1 wherein said first end is flat.

5. The device as recited in claim 1 wherein said first end is concave.

6. The device as recited in claim 1 wherein said plurality of grooves extend from said first end to said second end.

7. The device as recited in claim 1 wherein said flexible head portion has a substantially multi-pointed cross-sectional shape.

8. The device as recited in claim 1 wherein said flexible head portion has a substantially clover-leaf cross-sectional shape.

9. The device as recited in claim 1 wherein said handle portion is detachably securable to said flexible head portion.

10. The device as recited in claim 1 wherein said flexible head portion comprises a smooth outer surface.

11. The device as recited in claim 10 wherein said smooth outer surface is hydrophobic.

12. The device as recited in claim 11 wherein said smooth outer surface comprises a flexible non-stick coating.

13. The device as recited in claim 1 wherein said flexible head portion is capable of expansion and contraction.

14. The device as recited in claim 1 wherein said flexible head is formed from a material selected from the group consisting of rubber, foam, and soft plastic.

15. A device for removing an obstruction from a pipe comprising:

a flexible head portion having a first end operatively arranged for insertion into said pipe, said flexible head portion configured to allow said liquid to pass between the outer surface of said flexible head portion and the wall of said pipe for moving a column of liquid within said pipe;

a plurality of longitudinal grooves extending along the length of said flexible head portion; and a handle portion configured for a user to grasp and attached to a second end of the flexible head portion, where the second end of the flexible head portion has a substantially similar diameter as the diameter of the handle portion at the location where the second end and the handle portion are attached to each other;

wherein an entire body of said flexible head portion from the second end attached to the handle to a first end opposite the second end is formed from a flexible material.

16. The device as recited in claim 15 wherein said elongated grooves terminate prior to the first end.

17. The device as recited in claim 15 wherein said flexible head portion is shaped to taper toward said first end such that the flexible head portion has a substantially uniform thickness along a shaft of the flexible head portion until it tapers toward the first end, wherein a bottommost portion at the first end has a smaller diameter than the second end attached to the handle.

18. The device as recited in claim 15 wherein said first end is concave.

19. The device as recited in claim 15 wherein the body of said flexible head portion is hollow and the first end is covered to prevent water from entering the body.

20. The device as recited in claim 1 wherein a body of said flexible head portion is hollow and the first end is covered to prevent water from entering the body.

21. The device as recited in claim 1 wherein an entire body of said flexible head portion from the second end attached to the handle to a first end opposite the second end is formed from a flexible material.

22. A device for removing an obstruction from a pipe comprising:

a flexible head portion having a first end and a second end and operatively arranged for insertion into said pipe, said flexible head portion configured to allow said liquid to pass between the outer surface of said flexible head portion and the wall of said pipe for moving a column of liquid within said pipe;

a plurality of longitudinal grooves extending along the length of said flexible head portion; and a handle portion attached to said second end, where the second end of the flexible head portion has a substantially similar diameter as the diameter of the handle portion at the location where the second end and handle portion are attached to each other;

wherein said first end is concave.

23. The device as recited in claim 22 wherein an entire body of said flexible head portion from the second end attached to the handle to a first end opposite the second end is formed from a flexible material.

24. The device as recited in claim 22 wherein said elongated grooves terminate prior to the first end.

25. The device as recited in claim 22 wherein said flexible head portion is shaped to taper toward said first end such that the flexible head portion has a substantially uniform thickness along a shaft of the flexible head portion until it tapers toward the first end, wherein a bottommost portion at the first end has a smaller diameter than the second end attached to the handle.

26. The device as recited in claim 22 wherein the body of said flexible head portion is hollow and the first end is covered to prevent water from entering the body.

27. The device as recited in claim 22 wherein the concave first end includes a concavity from a range of 1/16 inch to 1/4 inch.

* * * * *